US005257812A

United States Patent [19]

Osorio et al.

[11] Patent Number: 5,257,812

[45] Date of Patent: Nov. 2, 1993

[54] POLISHED ROD PROTECTION AND SEALING DEVICE

[75] Inventors: Osmaly Osorio; Arcangel Hernandez, both of San Tomé, Venezuela

[73] Assignee: Corpoven, S.A., Caracas, Venezuela

[21] Appl. No.: 801,477

[22] Filed: Dec. 2, 1991

[51] Int. Cl.[5] ..... E21B 33/08

[52] U.S. Cl. ..... 166/84; 277/64; 277/66

[58] Field of Search ..... 166/84, 81, 82, 75.1; 277/66, 64, 59, 110, 19

[56] References Cited

U.S. PATENT DOCUMENTS

| | | | |
|---|---|---|---|
| 450,518 | 4/1891 | Mayer | 277/64 X |
| 1,971,542 | 8/1934 | Taylor | 277/19 X |
| 3,270,810 | 9/1966 | Johnston | 166/81 |
| 3,796,103 | 3/1974 | Winfield, Jr. | 74/18.2 |
| 3,815,925 | 6/1974 | Mattoon | 277/59 X |
| 3,967,678 | 7/1976 | Blackwell | 166/84 X |
| 4,099,562 | 7/1978 | Mattoon | 166/84 |
| 4,907,650 | 3/1990 | Heinonen | 166/84 X |
| 4,917,190 | 4/1990 | Coppedge | 166/84 X |

FOREIGN PATENT DOCUMENTS

| | | | |
|---|---|---|---|
| 252977 | 7/1970 | U.S.S.R. | 166/84 |

*Primary Examiner*—Hoang C. Dang

*Attorney, Agent, or Firm*—Bachman & LaPointe

[57] ABSTRACT

A reciprocable polished rod projects through a housing and a stuffing box downstream of the housing. A plurality of packings are provided in the upper portion of the housing and contacting the rod preventing fluid leakage from the housing. A retainer holds the packings in place and adjustable pressure is exerted on the retainer and on the packings.

3 Claims, 3 Drawing Sheets

POLISHED ROD PROTECTION AND SEALING DEVICE

BACKGROUND OF THE INVENTION

The present invention relates to a polished rod protection device for such rods as are used in hydrocarbon producing wells, and particularly to such a device that protects the integrity of seals in a stuffing box used in conjunction with said polished rod.

In the oil well pumping art, reciprocable polished rods are used to actuate a pump at the bottom of the well by connecting same to external means of reciprocation. The polished rod extends through a stuffing box which includes packings engaging the reciprocating rod to prevent the fluid product of the well from escaping past the polished rod.

However, it is very difficult to provide a reliable seal between the polished rod and the stuffing box, and one reason for this is the accumulation of materials on the rod which are abrasive to the stuffing box packings, such as material originating from atmospheric dust. Moreover, the fluid does not always move slowly through the stuffing box. Sometimes, due to high pressure, the stuffing box packings explode and the fluid blasts into the atmosphere causing severe problems, as environmental pollution, loss of fluid, damage to surrounding areas and possibly even injuries.

In order to avoid these problems frequent replacement of the packings have been proposed. However, this results in a considerable cost increase in equipment and maintenance.

One of the best ways to solve this problem is by protecting a segment of the polished rod which is adjacent to the stuffing box in order to control fluid leakage from the stuffing box and feed it outward. For example, U.S. Pat. No. 3,796,103 describes a device which is placed above the stuffing box, extensible to a portion of the rod and which avoids dust deposit or other abrasive materials tending to adhere to the rod and which would be carried to the packings within the stuffing box. However, this is a fairly complex device which is not entirely satisfactory.

Efforts have also been made to lead the fluid into adjacent or remote containers in order to solve the leakage problem. However, this requires the installation of conduit pipes for transporting the escaped fluid and requires a more sophisticated infrastructure.

Accordingly, it is a principal object of the present invention to provide a simple, convenient and inexpensive polished rod protection and sealing device.

It is a further object of the present invention to provide a device as aforesaid which protects the integrity of seals in a stuffing box used in conjunction with a polished rod.

Further objects and advantages of the present invention will appear hereinbelow.

SUMMARY OF THE INVENTION

It has now been found that the foregoing objects and advantages can be readily obtained in accordance with the present invention.

The polished rod protection and sealing device for protection and sealing of polished rods used in hydrocarbon producing wells of the present invention comprises: A housing having a lower portion and an upper portion; a reciprocable polished rod projecting through said housing; a stuffing box downstream of said housing wherein said rod projects through said stuffing box; a chamber in said housing between said housing and rod for retention of fluids escaping from the stuffing box; a plurality of packing means in the upper portion of said housing contacting said rod for preventing fluid leakage from the housing; retention means for holding said packing means in place; and means for exerting adjustable pressure on the retaining means and packing means.

The housing is preferably an annular housing and the chamber is therefore preferably an annular chamber. The housing is preferably connected to the stuffing box at the lower end thereof, wherein said stuffing box includes packing means contacting the rod for preventing fluid leakage from the stuffing box to the housing.

The retention means comprises a cup-like member with an internal space therein for holding the packing means and with an axially extending wall adjacent and contacting a wall of the housing. Preferably, a plurality of elastomeric packings are provided in both the stuffing box and housing, thereby providing a double safeguard against leakage.

The retention means is adjacent the upper end of the housing and is seated therein. A control piece is affixed to the upper end of the housing operative to apply pressure to the retention means and packings therein.

Thus, the device of the present invention is easy to install at the upper edge or head of a stuffing box. Leakages from the stuffing box are passed to the housing wherein the fluid may be used for lubrication of the polished rod. The device of the present invention provides a simple and convenient way to control leakage wherein a torque force is applied at the upper end of the device in order to adjust the sealing of the packings. Further features and advantages of the present invention will appear hereinbelow.

BRIEF DESCRIPTION OF THE DRAWINGS

The features of the present invention will be more readily understandable from a consideration of the following illustrative embodiments in which.

DETAILED DESCRIPTION

Figure 1:
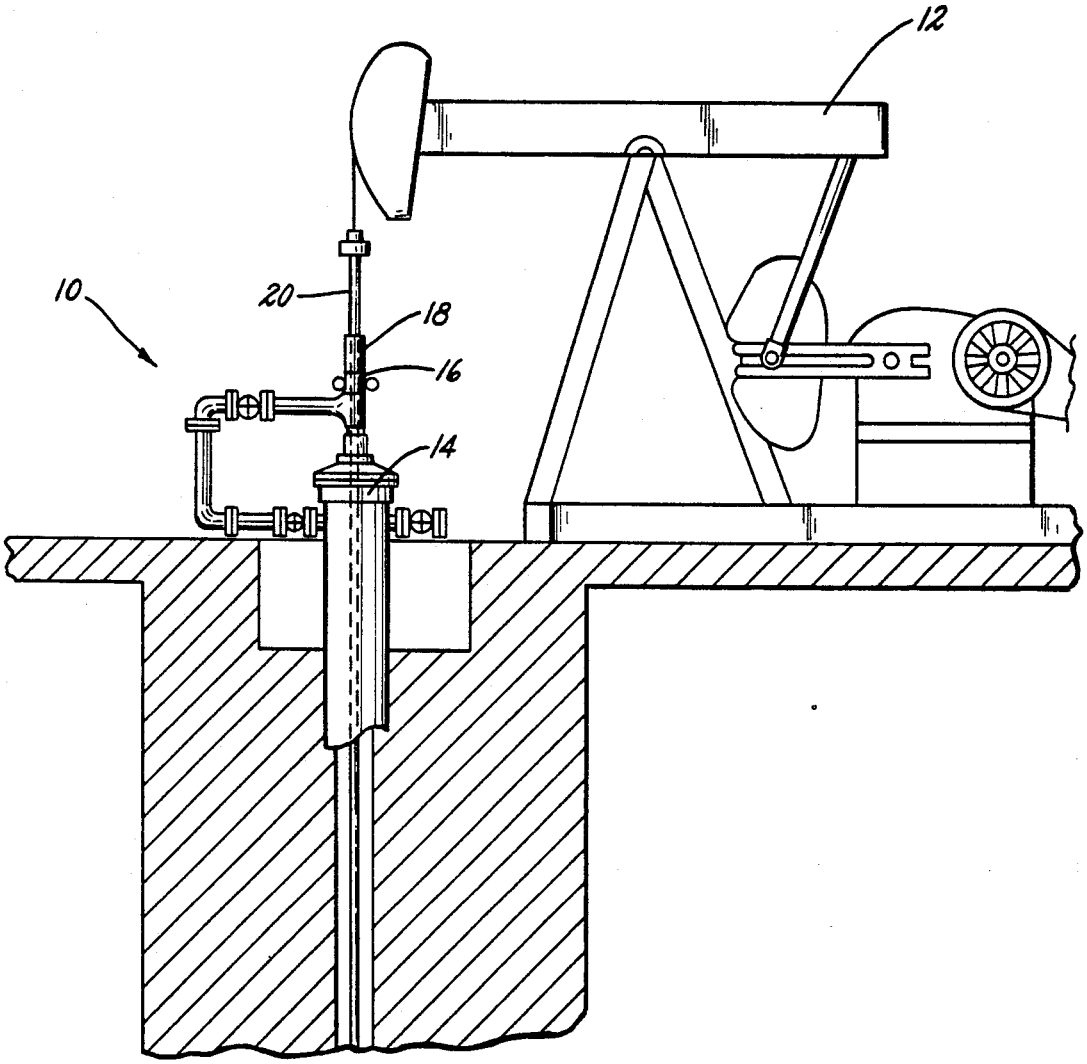
FIG. 1 is a general view of a mechanical pumping system incorporating the device of the present invention.

FIG. 1 shows a hydrocarbon producing well 10 which utilizes mechanical pumping including pumping unit 12, production head 14, stuffing box 16, housing of the present invention 18 installed on top of and directly adjacent stuffing box 16, and polished rod 20 passing through both the stuffing box housing. The housing is installed at the nearest superior edge of the stuffing box. The polished rod is connected at its lower end to a string of sucker rods (not shown) extending to the bottom of the well to actuate a pump (also not shown) in a known manner.

The principal objective of the present invention is to provide a polished rod protection and sealing device for a stuffing box within a mechanical well pumping unit as shown in FIG. 1 which is connected to the upper end of the head of the stuffing box, thereby lengthening the useful life of the packings of the stuffing box and providing an additional means for controlling fluid leakage from the well especially caused by wear and tear on the packings due to continuous contact with the reciprocating polished rod.

Figure 2:
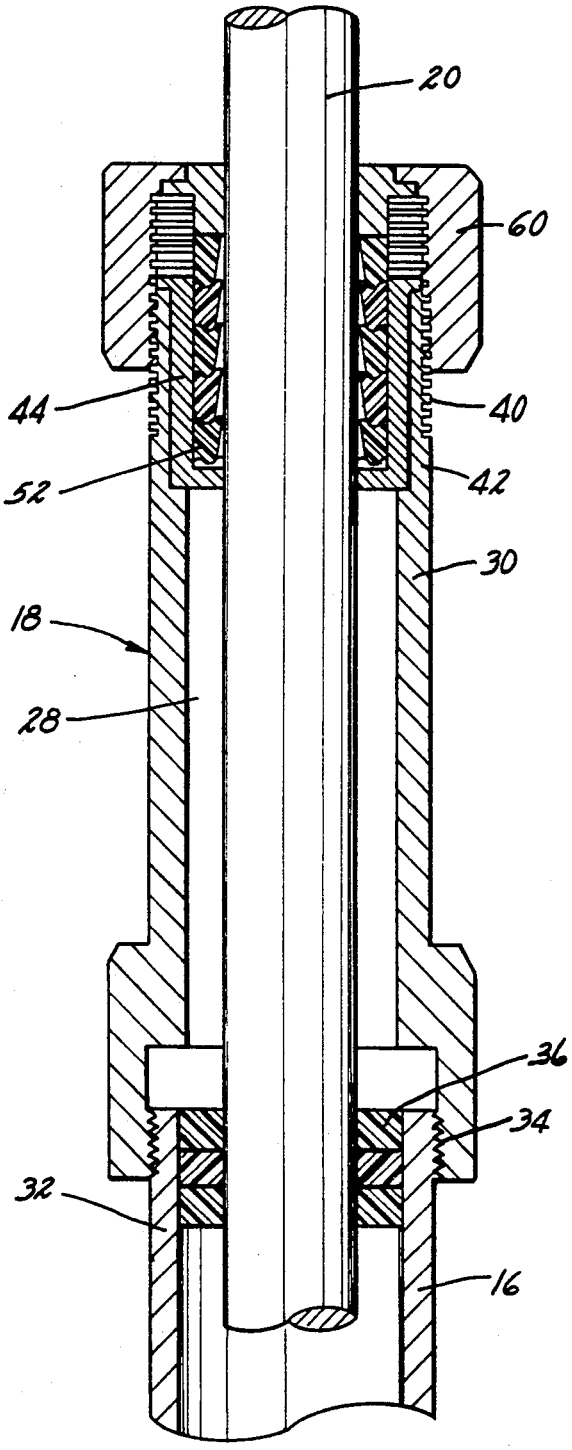
FIG. 2 is a cross-sectional view of the device of the present invention.

The device of the present invention achieves these goals. Referring to FIG. 2 wherein the polished rod protection and sealing device of the present invention is shown, housing 18 comprises an essentially cylindrical container 30 which is affixed to stuffing box 16 at the upper or superior end thereof 32 by for example threaded engagement 34 although naturally other methods of connection may be used. A plurality of elastomeric packing means 36, three are shown in FIG. 2, are provided at the upper end of the stuffing box. Thus, as shown in FIGS. 1-2 the stuffing box is downstream of the housing.

Polished rod 20 projects through both housing 18 and stuffing box 16. The housing 18 is substantially annular and includes a chamber therein as a substantially annular space 28 between the housing and polished rod. Fluids resulting from leakage from stuffing box 16 are deposited in annular space 28 which may be usefully employed in the lubrication of polished rod 20 and/or may simply be drawn off as from a side channel (not shown).

Figure 3:
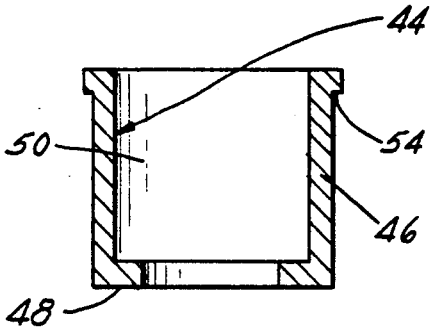
FIG. 3 is a detailed cross-sectional view of the retaining means.
Figure 5:
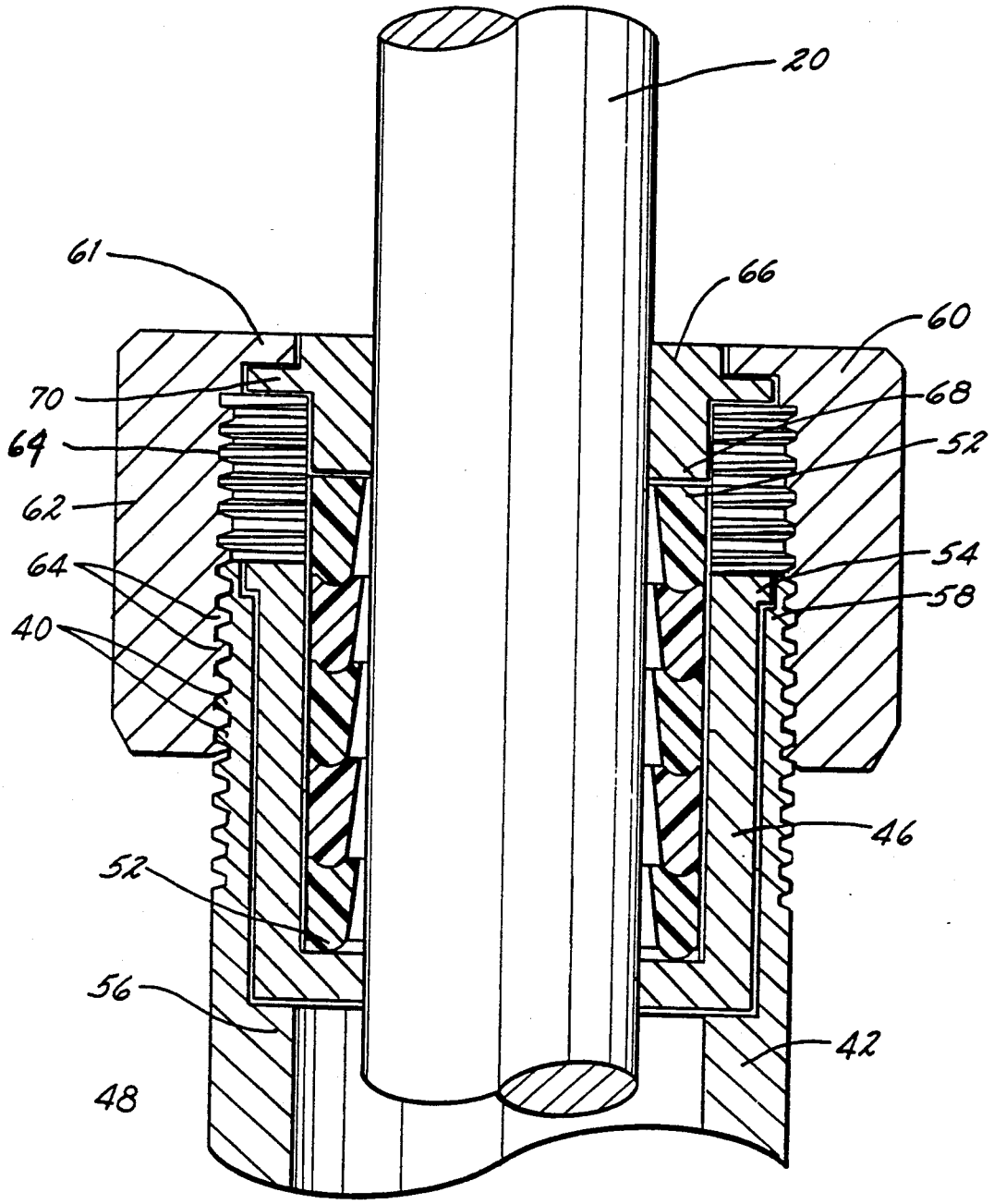
FIG. 5 is a an enlarged cross-sectional view of the upper portion of the housing including packing means and retention means.

Housing 18 also has an outer thread 40 at the upper end 42 thereof. Retention means 44 comprises a cup-like number (see FIG. 3) open at the top and having an axially extending wall 46 and an inwardly extending lower wall 48 defining a passageway for the rod 20 to pass through. Retention means 44 also includes an internal space 50 for holding a plurality of packing means 52 therein as shown in FIG. 2 (with five shown in FIG. 2). Retention means 44 also includes an outwardly extending upper flange 54. The retention means is seated in the upper end 42 of housing 18, with lower wall 48 resting on inwardly projecting interior bevel 56 of housing 18 (see FIG. 5). Outward flange 54 rests upon inwardly projecting upper housing bevel 58.

Control piece 60 is affixed to the upper end of the housing 42 and comprises a cup-like member with an inwardly extending upper flange 61 and descending arms 62 having internal threads 64 engaging housing outer threads 40. The screw engagement of the control piece 60 with housing threads 40 applies adjustable pressure to axial walls 46 of retention means 44 and to packing means 52.

Figure 4:
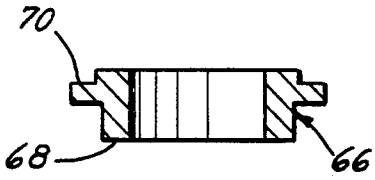
FIG. 4 is a detailed cross-sectional view of an inner fitting piece.

In addition, an inner fitting piece 66 is provided at housing upper end 42 having a lower end 68 and an outwardly extending flange 70 (see FIG. 4). Lower end 68 contacts packings 52 and flange 70 engages control piece flange 61 and holds the fitting piece in place. Thus, the control piece is the last piece of the assembly applied and applies the required torque to the packing means 52 in order to maintain the sealing action of the packing means against rod 20.

Thus, the present invention obtains a double-action control by providing packing means in the stuffing box and in the housing and improves the assembly by applying adjustable torque force by means of a control piece acting on the housing packing means.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A polished rod protection and sealing device for protection and sealing of polished rods used in hydrocarbon producing wells, which comprises: a stuffing box having an upper end; a housing having a lower end connected to the upper end of the stuffing box and an upper end; a polished rod reciprocally mounted within said stuffing box and said housing and defining with each a first annular space and a second annular space respectively; first packing means disposed within said first annular space for sealing the polished rod within said stuffing box; a cup-like retention means removably disposed within said second annular space at the upper end of the housing, said cup-like retention means including first means comprising a flange for abutting a shoulder provided within the upper end of the housing for supporting said cup-like retention means within said second annular space and second means for defining with said polished rod a third annular space; second packing means disposed within said third annular space for sealing the polished rod within the third annular space; pressure adjustment means movably secured to the upper end of the housing for selectively adjusting the pressure on said second packing means; and an intermediate member provided between the second packing means and the pressure adjustment means, said intermediate member having a first surface abutting the second packing means and a second surface abutting the pressure adjustment means.

2. A device according to claim 1 wherein the upper end of the housing has an end and the first means of the cup-like retention means comprises a flange which abuts the end of the upper end of the housing.

3. A device according to claim 1 wherein the second surface of the intermediate member comprises a flange.

* * * * *